US007435335B1

(12) United States Patent
Ellis et al.

(10) Patent No.: US 7,435,335 B1
(45) **Date of Patent: *Oct. 14, 2008**

(54) PRODUCTION OF LOW SULFUR DISTILLATES

(75) Inventors: Edward S. Ellis, Basking Ridge, NJ (US); William E. Lewis, Baton Rouge, LA (US); Larry L. Iaccino, Friendswood, TX (US); Michele S. Touvelle, Baton Rouge, LA (US); Gordon F. Stuntz, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/553,107

(22) Filed: Apr. 20, 2000

Related U.S. Application Data

(63) Continuation-in-part of application No. 09/457,434, filed on Dec. 7, 1999, now Pat. No. 6,835,301.

(60) Provisional application No. 60/111,346, filed on Dec. 8, 1998.

(51) Int. Cl.
*C10G 45/00* (2006.01)
*C10G 45/44* (2006.01)

(52) U.S. Cl. ..... 208/210; 208/216 R; 208/217; 208/15; 585/14

(58) Field of Classification Search ..... 208/210, 208/216 R, 217, 15; 585/14
See application file for complete search history.

(56) References Cited

U.S. PATENT DOCUMENTS

| | | | | |
|---|---|---|---|---|
| 4,243,519 | A * | 1/1981 | Schorfheide | |
| 5,114,562 | A | 5/1992 | Haun et al. | 208/89 |
| 5,183,556 | A * | 2/1993 | Reilly et al. | |
| 5,292,428 | A * | 3/1994 | Harrison et al. | |
| 5,516,342 | A * | 5/1996 | Cherpeck | 44/347 |
| 6,231,753 | B1 | 5/2001 | McKnight et al. | 208/217 |
| 6,461,497 | B1 * | 10/2002 | Pedersen | |
| 6,824,673 | B1 * | 11/2004 | Ellis et al. | 208/58 |
| 6,835,301 | B1 * | 12/2004 | Ellis et al. | 208/89 |

FOREIGN PATENT DOCUMENTS

| | | |
|---|---|---|
| EP | 0902078 | 3/1999 |
| EP | 0727474 | 8/1999 |
| WO | WO 00/34416 | 6/2000 |

* cited by examiner

*Primary Examiner*—Ellen M. McAvoy
(74) *Attorney, Agent, or Firm*—Gerard J. Hughes; Lawrence E. Carter

(57) ABSTRACT

A process for hydroprocessing a distillate stream to produce a stream exceptionally low in sulfur, with total aromatics and polynuclear aromatics being moderately reduced. A distillate stream is hydrodesulfurized in a first hydrodesulfurization stage. The product stream thereof is passed to a first separation stage wherein a vapor phase product stream and a liquid product stream are produced. The liquid phase product stream is passed to a second hydrodesulfurization stage and the product stream thereof is passed to a second separation stage wherein a vapor phase product stream and a liquid product stream low in sulfur are produced. At least a portion of the vapor product stream from said second separation stage can be cascaded to the first hydrodesulfurization stage.

13 Claims, 2 Drawing Sheets

PRODUCTION OF LOW SULFUR DISTILLATES

CROSS REFERENCE TO RELATED APPLICATIONS

This is a Continuation-in-Part of U.S. Ser. No. 09/457,434 filed Dec. 7, 1999, now U.S. Pat. No. 6,835,301 which claims priority from U.S. Provisional Patent Application No. 60/111,346, filed Dec. 8, 1998.

FIELD OF THE INVENTION

The present invention relates to a process for hydroprocessing a distillate stream to produce a stream exceptionally low in sulfur, with total aromatics and polynuclear aromatics being moderately reduced. A distillate stream is hydrodesulfurized in a first hydrodesulfurization stage. The product stream thereof is passed to a first separation stage wherein a vapor phase product stream and a liquid product stream are produced. The liquid phase product stream is passed to a second hydrodesulfurization stage and the product stream thereof is passed to a second separation stage wherein a vapor phase product stream and a liquid product stream low in sulfur are produced. At least a portion of the vapor product stream from said second separation stage can be cascaded to the first hydrodesulfurization stage.

BACKGROUND OF THE INVENTION

Environmental and regulatory initiatives are requiring ever lower levels of both sulfur and aromatics in distillate fuels. For example, proposed sulfur limits for distillate fuels to be marketed in the European Union for the year 2005 is 50 wppm or less. There are also proposed limits that would require lower levels of total aromatics as well as lower levels of multi-ring aromatics found in distillate fuels and heavier hydrocarbon products. Further, the maximum allowable total aromatics level for California Air Resources Board "CARB" reference diesel and Swedish Class I diesel are 10 and 5 vol. %, respectively. Further, the CARB reference fuels allows no more than 1.4 vol. % polynuclear aromatics (PNAs). Consequently, much work is presently being done in the hydrotreating art because of these proposed regulations.

Hydrotreating, or in the case of sulfur removal, hydrodesulfurization, is well known in the art and typically requires treating the petroleum streams with hydrogen in the presence of a supported catalyst at hydrotreating conditions. The catalyst is usually comprised of a Group VI metal with one or more Group VIII metals as promoters on a refractory support. Hydrotreating catalysts that are particularly suitable for hydrodesulfurization, as well as hydrodenitrogenation, generally contain molybdenum or tungsten as the Group VI metal on alumina support promoted with cobalt, nickel, iron, or a combination thereof as the Group VIII metal. Cobalt promoted molybdenum on alumina catalysts are most widely used when the limiting specifications are hydrodesulfurization, while nickel promoted molybdenum on alumina catalysts are the most widely used for hydrodenitrogenation, partial aromatic saturation, as well as hydrodesulfurization.

Much work is also being done to develop more active catalysts and to improve reaction vessel designs in order to meet the demand for more effective hydroprocessing processes. Various improved hardware configurations have been suggested. One such configuration is a co-current design where feedstock flows downwardly through successive catalyst beds and treat gas, which is typically a hydrogen-containing treat gas, also flows downwardly, co-current with the feedstock. Another configuration is a countercurrent design wherein the feedstock flows downwardly through successive catalyst beds counter to upflowing treat gas, which is typically a hydrogen-containing treat-gas. The downstream catalyst beds, relative to the flow of feed, can contain high performance but otherwise more sulfur sensitive catalysts because the upflowing treat gas carries away heteroatom components, such as $H_2S$ and $NH_3$, that are deleterious to sulfur and nitrogen sensitive catalysts.

Other process configurations include the use of multiple reaction stages, either in a single reaction vessel, or in separate reaction vessels. More sulfur sensitive catalysts can be used in the downstream stages as the level of heteroatom components becomes successively lower. European Patent Application 93200165.4 teaches such a two-stage hydrotreating process performed in a single reaction vessel.

Two types of process schemes are commonly employed to achieve substantial hydrodesulfurization (HDS) and aromatics saturation (ASAT) of distillate fuels and both are operated at relatively high pressures. One is a single stage process using Ni/Mo or Ni/W sulfide catalysts operating at pressures in excess of 800 psig. To achieve high levels of saturation, pressures in excess of 2,000 psig are required. The other process scheme is a two stage process in which the feed is first processed over a Co/Mo, Ni/Mo or Ni/W sulfide catalyst at moderate pressure to reduce heteroatom levels while little aromatics saturation is observed. After the first stage, the product stream is stripped to remove $H_2S$, $NH_3$ and light hydrocarbons. The first stage product is then reacted over a Group VIII metal hydrogenation catalyst at elevated pressure to achieve aromatics saturation. Such two stage processes are typically operated between 600 and 1,500 psig.

In light of the above, there is a need for improved hydroprocessing methods for treating feedstreams so that they can meet the ever stricter environmental regulations.

SUMMARY OF THE INVENTION

In accordance with the present invention there is provided a multi stage process for reducing the sulfur content of a distillate feedstock having a sulfur content greater than about 3,000 wppm, which process comprises:

a) reacting said feedstream in a first hydrodesulfurization stage in the presence of a hydrogen-containing treat gas, said first hydrotreating stage containing one or more reaction zones, each reaction zone operated at hydrodesulfurizing conditions and in the presence of a hydrodesulfurization catalyst, thereby resulting in a liquid product stream having a sulfur content less than about 1,000 wppm;

b) passing the liquid product stream to a separation zone wherein a vapor phase product stream and a liquid phase product stream are produced;

c) passing the liquid phase stream to a second hydrodesulfurization stage;

d) reacting said liquid phase product stream in said second hydrodesulfurization stage in the presence of a hydrogen-containing treat gas, which hydrogen-containing treat gas does not include recycle treat gas, said second hydrodesulfurization stage containing one or more reaction zones operated at hydrodesulfurization conditions wherein each reaction zone contains a bed of hydrotreating catalyst, thereby resulting in a liquid product stream having less than about 100 wppm sulfur; and e) passing the liquid product stream of step d) above to a separation zone wherein a vapor phase stream and a liquid phase stream are produced.

In a preferred embodiment of the present invention at least a portion of the vapor product stream from the first separation zone is recycled to the first hydrodesulfurization stage.

In another preferred embodiment of the present invention at least a portion of the vapor product stream from the second separation stage is cascaded to said first hydrodesulfurization stage.

In another preferred embodiment, the invention further comprises combining at least a portion of the liquid phase stream of step (e) with at least one of (i) one or more lubricity aid, (ii) one or more viscosity modifier, (iii) one or more antioxidant, (iv) one or more cetane improver, (v) one or more dispersant, (vi) one or more cold flow improver, (vii) one or more metals deactivator, (viii) one or more corrosion inhibitor, (ix) one or more detergent, and (x) one or more distillate or upgraded distillate.

In another embodiment, the invention is a product made in accordance with the above processes.

DETAILED DESCRIPTION OF THE INVENTION

Feedstreams suitable for being treated by the present invention are those petroleum based feedstocks boiling in the distillate range and above (i.e. "distillate"). Such feedstreams typically have a boiling range from about 150 to about 400° C., preferably from about 175 to about 370° C. These feedstreams usually contain greater than about 3,000 wppm sulfur. Non-limiting examples of such feedstreams include virgin distillates, light cat cycle oils, light coker oils, etc. It is highly desirable for the refiner to upgrade these types of feedstreams by removing heteroatoms such as sulfur, as well as to saturate aromatic compounds.

Figure 1:
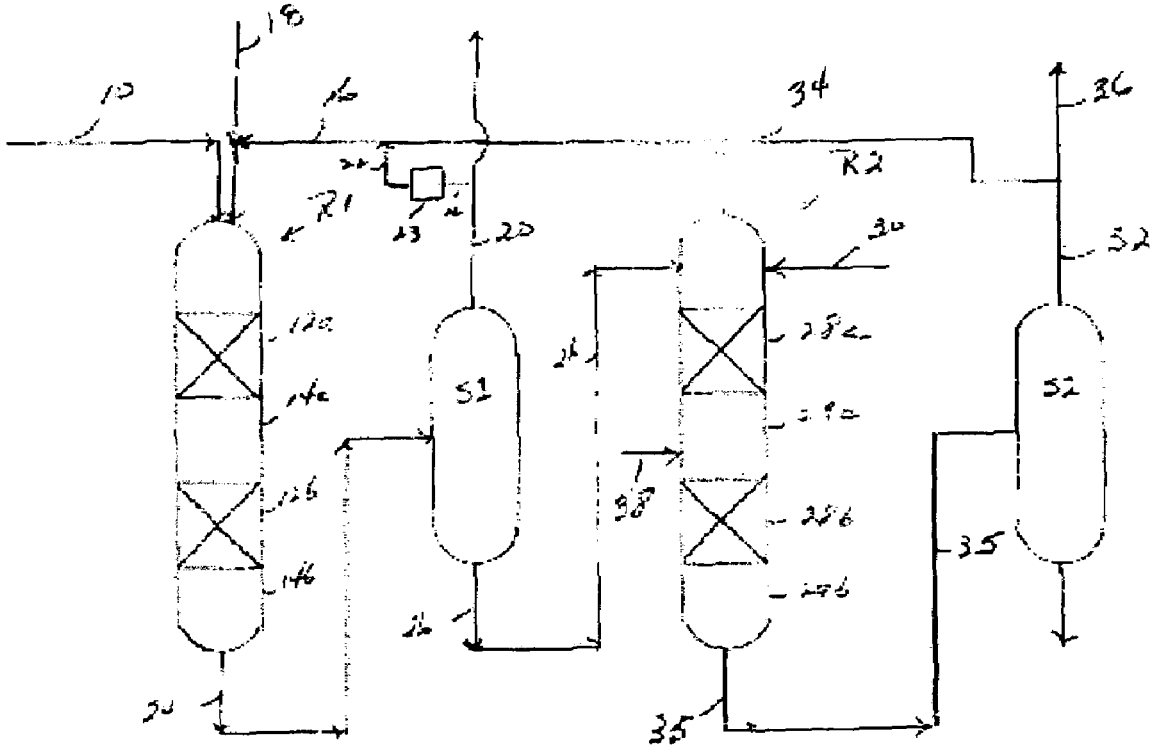
FIG. 1 hereof shows a preferred embodiment of the present invention and includes two co-current hydrodesulfurization stages with once through hydrogen containing treat gas in the second hydrodesulfurization stage.

The process of the present invention can be better understood by a description of a preferred embodiment illustrated by FIG. 1 hereof. Importantly, the embodiment of FIG. 1 uses once-through hydrogen treat gas in a second hydrodesulfurization stage and optionally in a first hydrodesulfurization stage as well. Relatively low amounts of hydrogen are utilized in the second hydrodesulfurization stage in such a way that very low levels of sulfur in the liquid product can be achieved while minimizing the amount of hydrogen consumed via saturation of the aromatics. Preferably, the first hydrodesulfurization stage will reduce the levels of both sulfur and nitrogen, with sulfur levels being less than about 1,000 wppm, preferably less than about 500 wppm. The second hydrodesulfurization stage will reduce sulfur levels to less than about 100 wppm, preferably to less than about 50 wppm. In the practice of this invention the hydrogen in the treat gas reacts with impurities to convert them to $H_2S$, $NH_3$, and water vapor, which are removed as part of the vapor effluent, and it also saturates olefins and aromatics.

Miscellaneous reaction vessel internals, valves, pumps, thermocouples, and heat transfer devices etc. are not shown for simplicity. FIG. 1 shows hydrodesulfurization reaction vessel R1 that contains reaction zones 12*a* and 12*b*, each of which is comprised of a bed of hydrodesulfurization catalyst. Although two zones are shown in R1, it will be understood that this reaction stage may contain only one reaction zone or alternatively two or more reaction zones. It is preferred that the catalyst be in the reactor as a fixed bed, although other types of catalyst arrangements can be used, such as slurry or ebullating beds. Downstream of each reaction zone is a non-reaction zone, 14*a* and 14*b*. The non-reaction zone is typically void of catalyst, that is, it will be an empty section in the vessel with respect to catalyst. Although not shown, there may also be provided a liquid distribution means upstream of each reaction stage. The type of liquid distribution means is believed not to limit the practice of the present invention, but a tray arrangement is preferred, such as sieve trays, bubble cap trays, or trays with spray nozzles, chimneys, tubes, etc. A vapor-liquid mixing device (not shown) can also be employed in non-reaction zone 14*a* for the purpose of introducing a quench fluid (liquid or vapor) for temperature control.

The feedstream is fed to reaction vessel R1 via line 10 along with a hydrogen-containing treat gas via line 18, which treat gas will typically be from another refinery process unit, such as a naphtha hydrofiner. It is within the scope of this invention that treat gas can also be recycled via lines 20, 22, and 16 from separation zone S1. The term "recycled" when used herein regarding hydrogen treat gas is meant to indicate a stream of hydrogen-containing treat gas separated as a vapor effluent from one stage that passes through a gas compressor 23 to increase its pressure prior to being sent to the inlet of a reaction stage. It should be noted that the compressor will also generally include a scrubber to remove undesirable species such as $H_2S$ from the hydrogen recycle stream. The feedstream and hydrogen-containing treat gas pass, co-currently, through the one or more reaction zones of hydrodesulfurization stage R1 to remove a substantial amount of the heteroatoms, preferably sulfur, from the feedstream. It is preferred that the first hydrodesulfurization stage contain a catalyst comprised of Co—Mo, or Ni—Mo on a refractory support.

The term "hydrodesulfurization" as used herein refers to processes wherein a hydrogen-containing treat gas is used in the presence of a suitable catalyst which is primarily active for the removal of heteroatoms, preferably sulfur, and nitrogen, and for some hydrogenation of aromatics. Suitable hydrodesulfurization catalysts for use in the reaction vessel R1 of the present invention include conventional hydrodesulfurization catalysts such as those comprised of at least one Group VIII metal, preferably Fe, Co or Ni, more preferably Co and/or Ni, and most preferably Co; and at least one Group VI metal, preferably Mo or W, more preferably Mo, on a relatively high surface area refractory support material, preferably alumina. Other suitable hydrodesulfurization catalyst supports include refractory oxides such as silica, zeolites, amorphous silica-alumina, and titania-alumina. Additives such as P can also be present. It is within the scope of the present invention that more than one type of hydrodesulfurization catalyst be used in the same reaction vessel and in the same reaction zone. The Group VIII metal is typically present in an amount ranging from about 2 to 20 wt. %, preferably from about 4 to 15%. The Group VI metal will typically be present in an amount ranging from about 5 to 50 wt. %, preferably from about 10 to 40 wt. %, and more preferably from about 20 to 30 wt. %. All metals weight percents are based on the total weight of the catalyst. Typical hydrodesulfurization temperatures range from about 200° C. to about 400° C. with a total pressures of about 50 psig to about 3,000 psig, preferably from about 100 psig to about 2,500 psig, and more preferably from about 150 to 500 psig. More preferred hydrogen partial pressures will be from about 50 to 2,000 psig, most preferably from about 75 to 800 psig.

A combined liquid phase/vapor phase product stream exits hydrodesulfurization stage R1 via line 24 and passes to separation zone S1 wherein a liquid phase product stream is separated from a vapor phase product stream. The liquid phase product stream will typically be one that has components boiling in the range from about 150° C. to about 400° C., but will not have an upper boiling range greater than the feedstream. The vapor phase product stream is collected overhead via line 20. The liquid reaction product from separation zone S1 is passed to hydrodesulfurization stage R2 via line 26 and is passed downwardly through the reaction zones 28*a* and 28*b*. Non-reaction zones are represented by 29*a* and 29*b*.

Fresh hydrogen-containing treat gas is introduced into reaction stage R2 via line 30. Although this figure shows the treat gas flowing cocurrent with the liquid feedstream, it is also within the scope of this invention that the treat gas can be introduced into the bottom section of reactor R2 and flowed countercurrent to the downward flowing liquid feedstream. It is preferred that the rate of introduction of hydrogen contained in the treat gas be less than or equal to 3 times the chemical hydrogen consumption rate of this stage, more preferably less than about 2 times, and most preferably less than about 1.5 times. The feedstream and hydrogen-containing treat gas pass, preferably co-currently, through the one or more reaction zones of hydrodesulfurization stage R2 to remove a substantial amount of remaining sulfur, preferably to a level wherein the feedstream now has less than about 100 wppm sulfur, more preferably less than about 50 wppm sulfur.

Suitable hydrodesulfurization catalysts for use in the reaction vessel R2 in the present invention include conventional hydrodesulfurization catalyst such as those described for use in R1. Noble metal catalysts may also be employed, and preferably the noble metal is selected from Pt and Pd or a combination thereof. Pt, Pd or the combination thereof is typically present in an amount ranging from about 0.5 to 5 wt. %, preferably from about 0.6 to 1 wt. %. Typical hydrodesulfurization temperatures range from about 200° C. to about 400° C. with a total pressures of about 50 psig to about 3,000 psig, preferably from about 100 psig to about 2,500 psig, and more preferably from about 150 to 1,500 psig. More preferred hydrogen partial pressures will be from about 50 to 2,000 psig, most preferably from about 75 to 1,000 psig. In one embodiment, R2 outlet pressure ranges from about 500 to about 1000 psig.

It is within the scope of this invention that second reaction stage R2 contain two or more reaction zones wherein at least one of the reaction zones is operated at least 25° C., preferably at least about 50° C. cooler than the other reaction zone(s). It is preferred that the lower temperature zone(s) be operated at a temperature of at least about 50° C. lower than the higher temperature zone(s). It is preferred that the lower temperature zone be the last downstream zone(s) with respect to the flow of feedstock. It is also within the scope of this invention that the second reaction stage be operated in either cocurrent or countercurrent mode. By countercurrent mode we mean that the treat gas will flow counter to the downflowing feedstock.

The reaction product from second hydrodesulfurization stage R2 is passed via line 35 to a second separation zone S2 wherein a vapor product, containing hydrogen, is preferably recovered overhead via line 32 and may be removed from the process via line 36. When either (i) all hydrogen-containing treat gas introduced into a reactor is consumed therein or (ii) unreacted hydrogen-containing treat gas present in a reactor's vapor phase effluent and is conducted away from the reactor, then the treat gas is referred to as a "once-through" treat gas. Alternatively, all or a portion of the vapor product may be cascaded to hydrodesulfurization stage R1 via lines 34 and 16. The term "cascaded", when used in conjunction with treat gas is meant to indicate a stream of hydrogen-containing treat gas separated as a vapor effluent from one stage that is sent to the inlet of a reaction stage without passing through a gas compressor. That is, the treat gas flows from a downstream reaction stage to an upstream stage that is at the same or lower pressure, and thus there is no need for the gas to be compressed.

FIG. 1 also shows several optional processing schemes. For example, line 38 can carry a quench fluid that may be either a liquid or a gas. Hydrogen is a preferred gas quench fluid and kerosene is a preferred liquid quench fluid.

The reaction stages used in the practice of the present invention are operated at suitable temperatures and pressures for the desired reaction. For example, typical hydroprocessing temperatures will range from about 200° C. to about 400° C. at pressures from about 50 psig to about 3,000 psig, preferably 50 to 2,500 psig, and more preferably about 150 to 1,500 psig. Furthermore, reaction stage R2 can be operated in two or more temperature zones wherein the most downstream temperature zone is at least about 25° C., preferably about 35° C., cooler than the upstream temperature zone(s).

For purposes of hydroprocessing and in the context of the present invention, the terms "hydrogen" and "hydrogen-containing treat gas" are synonymous and may be either pure hydrogen or a hydrogen-containing treat gas which is a treat gas stream containing hydrogen in an amount at least sufficient for the intended reaction, plus other gas or gasses (e.g., nitrogen and light hydrocarbons such as methane) which will not adversely interfere with or affect either the reactions or the products. Impurities, such as $H_2S$ and $NH_3$ are undesirable and, if present in significant amounts, will normally be removed from the treat gas, before it is fed into the R1 reactor. The treat gas stream introduced into a reaction stage will preferably contain at least about 50 vol. % hydrogen, more preferably at least about 75 vol. % hydrogen, and most preferably at least 95 vol. % hydrogen. In operations in which unreacted hydrogen in the vapor effluent of any particular stage is used for hydroprocessing in any stage, there must be sufficient hydrogen present in the fresh treat gas introduced into that stage, for the vapor effluent of that stage to contain sufficient hydrogen for the subsequent stage or stages. The first stage vapor effluent will be cooled to condense and recover the hydrotreated and relatively clean, heavier (e.g., $C_4$+) hydrocarbons.

The liquid phase in the reaction vessels used in the present invention will typically be comprised of primarily the higher boiling point components of the feed. The vapor phase will typically be a mixture of hydrogen-containing treat gas, heteroatom impurities like $H_2S$ and $NH_3$, and vaporized lower-boiling components in the fresh feed, as well as light products of hydroprocessing reactions. If the vapor phase effluent still requires further hydroprocessing, it can be passed to a vapor phase reaction stage containing additional hydroprocessing catalyst and subjected to suitable hydroprocessing conditions for further reaction. Alternatively, the hydrocarbons in the vapor phase products can be condensed via cooling of the vapors, with the resulting condensate liquid being recycled to either of the reaction stages, if necessary.

The liquid phase products may be combined with other distillate or upgraded distillate. As discussed, the products are compatible with effective amounts of fuel additives such as lubricity aids, cetane improvers, and the like. While a major amount of the product is preferably combined with a minor amount of the additive, the fuel additive may be employed to an extent not impairing the performance of the fuel. While the specific amount(s) of any additive employed will vary depending on the use of the product, the amounts may generally range from 0.05 to 2.0 wt % based on the weight of the product and additive(s), although not limited to this range. The additives can be used either singly or in combination as desired.

As discussed, distillate fuel products that are characterized as having relatively low levels of sulfur and polynuclear aromatics (PNAs) and a relatively high ratio of total aromatics to PNAs may be formed in accordance with such processes. Such distillate fuels may be employed in compression-ignition engines such as diesel engines, particularly so-call "lean-burn" diesel engines. Such fuels are compatible with: compression-ignition engine systems such as automotive diesel systems utilizing (i) sulfur-sensitive NOx conversion exhaust catalysts, (ii) engine exhaust particulate emission reduction technology, including particulate traps, and (iii) combinations of (i) and (ii). Such distillate fuels have moderate levels of total aromatics, reducing the cost of producing cleaner-burning diesel fuel and also reducing $CO_2$ emissions by minimizing the amount of hydrogen consumed in the process.

In one embodiment, the distillate fuel products made in accordance with the process of the invention contain less than about 100 wppm, preferably less than about 50 wppm, more preferably less than about 10 wppm sulfur. Further, the distillate fuels of the present invention have relatively low amounts of low boiling material with a T10 distillation point of at least about 205° C. They will also have a total aromatics content from about 15 to 35 wt. %, preferably from about 20 to 35 wt. %, and most preferably from about 25 to 35 wt. %. The PNA content of the distillate product compositions obtained by the practice of the present invention will be less than about 3 wt. %, preferably less than about 2 wt. %, and more preferably less than about 1 wt. %. Such weight percents and weight ppms are based on the weight of the product. In one embodiment, the aromatics to PNA ratio will be at least about 11, preferably at least about 13, and more preferably at least about 15. In another embodiment, the aromatics to PNA ratio ranges from 11 to about 50, preferably from 11 to about 30, and more preferably from 11 to about 20.

The term PNA is meant to refer to polynuclear aromatics that are defined as aromatic species having two or more aromatic rings, including alkyl and olefin-substituted derivatives thereof. Naphthalene and phenanthrene are examples of PNAs. The term aromatics is meant to refer species containing one or more aromatic ring, including alkyl and olefin-substituted derivatives thereof. Thus, naphthalene and phenanthrene are also considered aromatics along with benzene, toluene and tetrahydronaphthalene. It is desirable to reduce PNA content of the liquid product stream since PNAs contribute significantly to emissions in diesel engines. However, it is also desirable to minimize hydrogen consumption for economic reasons and to minimize $CO_2$ emissions associated with the manufacture of hydrogen via steam reforming. Thus, the current invention achieves both of these by obtaining a high aromatics to PNA ratio in the liquid product.

The following examples are presented to illustrate the present invention and not to be taken as limiting the scope of the invention in any way.

EXAMPLES 1-5

A virgin distillate feed containing from about 10,000 to 12,000 wppm sulfur was processed in a commercial hydrodesulfurization unit (first hydrodesulfurization stage) using a reactor containing both conventional commercial $NiMo/Al_2O_3$ (Akzo-Nobel KF842/840) and $CoMo/Al_2O_3$ (Akzo-Nobel KF-752) catalyst under the following typical conditions: 300-350 psig; 150-180 psig outlet $H_2$; 75% $H_2$ treat gas; 500-700 SCF/B treat gas rate; 0.3-0.45 LHSV; 330-350° C. The liquid product stream from this first hydrodesulfurization stage was used as feedstream to the second hydrodesulfurization stage, which product stream is described under the feed properties heading in Table 1 below. The process conditions for this second hydrodesulfurization stage are also shown in the table below. A commercial NiMo catalyst (Criterion C-411 containing 2.6 wt % Ni and 14.3 wt % Mo) was used in all of the runs.

Examples 1-5 demonstrate that products with less than 100 wppm sulfur can be produced wherein the rate of introduction of hydrogen in the treat gas in the second reaction stage is less than or equal to three times the chemical hydrogen consumption.

TABLE 1

| | Example 1 | Example 2 | Example 3 | Example 4 | Example 5 |
|---|---|---|---|---|---|
| Feed properties to second stage | | | | | |
| S, wppm | 340 | 340 | 99 | 266 | 375 |
| N, wppm | 75 | 75 | 52 | 45 | 101 |
| API | 35.7 | 35.6 | 35.5 | 37.6 | 361 |
| T10, ° C. | 238 | 237 | 240 | 210 | 239 |
| T95, C | 367 | 367 | 374 | 363 | 366 |
| Total aromatics, wt % (HPLC IP 391/95) | 26.51 | 25.99 | 27.06 | 25.26 | 24.07 |
| PNA, wt % (HPLC IP 391/95) | 6.3 | 6.18 | 7.84 | 7.47 | 5.89 |
| H content, wt % | 13.47 | 13.51 | 13.35 | 13.52 | 13.55 |
| Product properties from second stage | | | | | |
| S, wppm | 32.5 | 34.5 | 18.6 | 1.4 | 61 |
| API | 36.7 | 36.7 | 36 | 39.1 | 37.2 |
| Total aromatics, wt % (HPLC IP 391/95) | 23.09 | 21.66 | 25.36 | 16.52 | 23.12 |
| PNA, wt % (HPLC IP 391/95) | 2.02 | 1.39 | 1.94 | 1.21 | 1.74 |
| Total aromatics/PNA | 11.43 | 15.58 | 13.07 | 14.24 | 13.28 |
| $H_2$ consumption, SCF/B | 162 | 196 | 175 | 263 | 220 |
| Process conditions for second stage | | | | | |
| T, C | 332 | 332 | 328 | 329 | 337 |
| Pressure, psig | 800 | 800 | 800 | 790 | 800 |
| LHSV | 1.1 | 1.1 | 1.3 | 0.58 | 1.1 |
| Treat gas rate (100% $H_2$), SCF/B | 490 | 480 | 520 | 555 | 530 |
| Treat gas rate/$H_2$ consumption for second stage | 3.0 | 2.4 | 3.0 | 2.3 | 2.4 |

Figure 2:
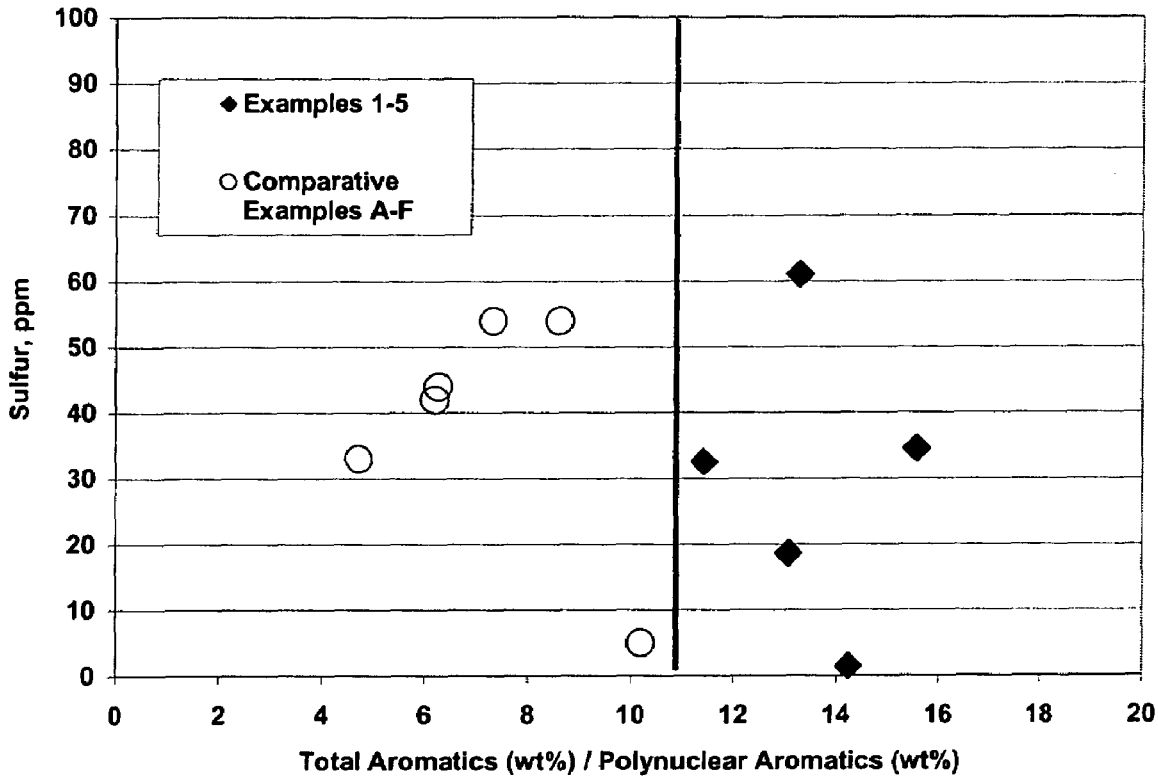
FIG. 2 hereof is a plot of that defines the composition of distillate products of the present invention where the sulfur content is less than 50 ppm and the ratio of aromatics to polynuclear aromatics is greater than about 11.

Referring now to FIG. 2, the area to the right of the vertical line in the FIG. 2 defines the products made in accordance with the present invention. The product total aromatics to PNA ratio of the invention can be greater than 20.

As may be seen by comparing Examples 1 and 2, the invention provides a method for regulating the total aromatics to PNA ratio by regulating the treat gas rate in R2. Such regulation may be accomplished for a constant sulfur amount in the product by, for example, decreasing the liquid space velocity in R2 as the treat gas rate is reduced.

Comparative Examples A-F in Table 2 below are all conventional fuel compositions containing less than 100 ppm sulfur and total aromatics levels greater than 15 wt %. All of them, however, have a ratio of total aromatics to PNAs less than 10 which is outside the range of the fuel compositions of the present invention.

TABLE 2

| | Comparative Example A | Comparative Example B | Comparative Example C | Comparative Example D | Comparative Example E | Comparative Example F |
|---|---|---|---|---|---|---|
| Reference | Executive Order G-714-007 Of the Calif. Air Resources Board | Executive Order G-714-008 Of the Calif. Air Resources Board | As described in U.S. Pat. No. 5792339 | U.S. Pat. No. 5389111 and U.S. Pat. No. 5389112 | U.S. Pat. No. 5389111 and U.S. Pat. No. 5389112 | U.S. Pat. No. 5389111 and U.S. Pat. No. 5389112 |
| Product properties | | | | | | |
| S, wppm | 33 | 42 | <5 | 44 | 54 | 54 |
| Total aromatics, vol % (D1319-84; FIA) | 21.7 | 24.7 | | | | |
| PNA, wt % (D 2425-83; mid-distillate MS) | 4.6 | 4.0 | 1.9 | 2.56 | 2.22 | 2.62 |
| Total aromatics, wt % (D 5186; SFC) | | | 19.4 | 16 | 19 | 19 |
| Total aromatics/PNA | 4.72 | 6.18 | 10.2 | 6.25 | 8.6 | 7.3 |

The designations "FIA", "MS", and "SFC" are well known in the art as analytical techniques. For example, "FIA" stands for fluorescence indicator analysis, "MS" stands for mass spectrophotometry; and "SFC" stands for supercritical fluid chromatography.

The area to the right of the vertical line in the FIG. 2 hereof defines the preferred products formed in the process of this invention. While FIG. 2's abscissa is truncated at 20, it should be understood that the preferred product's total aromatics to PNA ratio of the invention may exceed 20. In addition to the total aromatics (15-35 wt %) and total aromatics/PNA criteria, the preferred products have S levels less than about 100 wppm and a T10 point of >205° C.

What is claimed is:

1. A multi-stage process for reducing the level of sulfur in a distillate feedstock having a sulfur content greater than about 3,000 wppm, the distillate feedstock containing polynuclear aromatics, which process comprises:

a) reacting said feedstream in a first hydrodesulfurization stage in the presence of a hydrogen-containing treat gas comprised of i) the hydrogen-containing gas which is cascaded from the second hydrodesulfurization stage of d) below, and ii) a hydrogen-containing gas which is supplied from a source other than the present multi-stage process, said first hydrodesulfurization stage containing one or more reaction zones, each reaction zone operated at hydrodesulfurizing condition and in the presence of a hydrodesulfurization catalyst, thereby resulting in a liquid product stream having a sulfur content less than about 500 wppm;

b) passing the liquid product stream to a separation zone wherein a hydrogen-containing product gas stream and a liquid phase product stream are produced;

c) passing the liquid phase stream to a second hydrodesulfurization stage;

d) reacting said liquid phase product stream in said second hydrodesulfurization stage in the presence of a hydrogen-containing treat gas, wherein the rate of introduction of the hydrogen portion of the treat gas in this second stage is less than or equal to 3 times the chemical hydrogen consumption in this second reaction stage, said second hydrodesulfurization stage containing one or more reaction zones operated at hydrodesulfurization conditions wherein each reaction zone contains a bed of hydrotreating catalyst, thereby resulting in a liquid product stream having less than about 100 wppm sulfur and having a weight ratio of aromatics to polynuclear aromatics of at least about 11; and e) passing the liquid product stream of step d) above to a second separation zone wherein a hydrogen-containing product gas stream and a liquid phase product stream are produced.

2. The process of claim 1 wherein step d) is performed so that the liquid product stream contains less than about 50 wppm sulfur.

3. The process of claim 1 wherein step d) is performed so that the liquid product stream contains less than about 25 wppm sulfur.

4. The process of claim 1 wherein the catalyst of said first and second hydrodesulfurization stages are selected from catalysts comprised of at least one Group VI and at least one Group VIII metal on an inorganic refractory support.

5. The process of claim 4 wherein the Group VI metal is selected from Mo and W and the Group VIII metal is selected from Ni and Co.

6. The process of claim 1 wherein at least a portion of the hydrogen-containing product gas stream from said first separation stage is recycled to said first hydrodesulfurization stage.

7. The process of claim 1 wherein all of the hydrogen-containing product gas stream from said second separation stage is recycled to said first hydrodesulfurization stage.

8. The process of claim 7 wherein the rate of introduction of hydrogen contained in the treat gas in said second hydrodesulfurization stage is less than or equal to 2 times the chemical hydrogen consumption in said second hydrodesulfurization stage.

9. The process of claim 1 wherein said second hydrodesulfurization stage contains two or more reaction zones operated at different temperatures wherein at least one of said reaction zones is operated at least about 25° C. lower in temperature than the other reaction zone or zones.

10. The process of claim 9 wherein said second hydrodesulfurization stage contains two or more different reaction zones operated at different temperatures wherein at least one of said reaction zones is operated at least about 50° C. lower in temperature than the other reaction zone or zones.

11. The process of claim 9 wherein the last downstream reaction zone with respect to the flow of feedstock is the lower temperature reaction zone.

12. The process of claim 1 wherein a portion of the hydrogen-containing product gas stream from the second separation zone is conducted away from the process.

13. The process of claim 1 wherein the hydrogen-containing treat gas provided to the second hydrodesulfurization stage is a once-through treat gas.

* * * * *